US010159985B2

(12) United States Patent
Braun et al.

(10) Patent No.: US 10,159,985 B2
(45) Date of Patent: Dec. 25, 2018

(54) DEVICE AND METHOD FOR COMMINUTING PARTICLES IN LIQUID MATERIAL

(75) Inventors: Peter Braun, Kreuzlingen (CH); Stefan Gerber, Winterthur (CH); Frank Barthel, Uzwil (CH); Bernd Schmidt, Kirchberg (CH); Manuel Höhener, Uzwil (CH)

(73) Assignee: Bühler AG, Uzwil (CH)

( * ) Notice: Subject to any disclaimer, the term of this patent is extended or adjusted under 35 U.S.C. 154(b) by 510 days.

(21) Appl. No.: 14/116,431

(22) PCT Filed: May 14, 2012

(86) PCT No.: PCT/EP2012/058945

§ 371 (c)(1),
(2), (4) Date: Nov. 8, 2013

(87) PCT Pub. No.: WO2012/152951

PCT Pub. Date: Nov. 15, 2012

(65) Prior Publication Data

US 2014/0084092 A1 Mar. 27, 2014

(30) Foreign Application Priority Data

May 12, 2011 (EP) ..... 11165852

(51) Int. Cl.
*B02C 4/36* (2006.01)
*B02C 4/42* (2006.01)
(Continued)

(52) U.S. Cl.
CPC ..... *B02C 4/32* (2013.01); *B02C 4/286* (2013.01); *B02C 4/36* (2013.01); *B02C 4/42* (2013.01); *B02C 25/00* (2013.01)

(58) Field of Classification Search
CPC .. B02C 4/32; B02C 4/42; B02C 4/286; B02C 25/00; B02C 4/36; B02C 23/12; B02C 4/28; A23G 1/04; A23G 1/12
(Continued)

(56) References Cited

U.S. PATENT DOCUMENTS 1,894,569 A 1/1933 Mezger
3,837,586 A * 9/1974 Perschbacher ..... B02C 18/148 198/780
(Continued)

FOREIGN PATENT DOCUMENTS

CN 201079743 7/2008
CN 101257823 9/2008
(Continued)

OTHER PUBLICATIONS

Japanese Office Action for corresponding Japanese application dated Sep. 3, 2015.
(Continued)

*Primary Examiner* — James S McClellan
*Assistant Examiner* — Peter Iannuzzi
(74) *Attorney, Agent, or Firm* — Davis & Bujold PLLC; Michael J. Bujold

(57) ABSTRACT

The invention relates to a device (1) for comminuting particles in a liquid material, in particular a powder or a semi-liquid for producing a chocolate mass. Said device (1) comprises at least one pair of rollers (2, 3), for which at least one process parameter, in particular the roller contact pressure and/or the rotational speed of one of the rollers (2, 3) can be adjusted. The invention also relates to a device (1) comprising a filling level meter (11) for measuring the height of the filling level (5) of the liquid material in the roller gap or in a roller trough (4) arranged upstream of the rollers. A control unit (11) modifies at least one process
(Continued)

parameter in accordance with the measured height of the filling level (5) of the liquid material in the roller gap or in the roller trough (4). The invention also relates to a method for comminuting particles in a liquid material and to a method for calibrating a control unit (10).

10 Claims, 5 Drawing Sheets

(51) Int. Cl.
*B02C 4/32* (2006.01)
*B02C 4/28* (2006.01)
*B02C 25/00* (2006.01)

(58) Field of Classification Search
USPC ..... 241/29, 30, 33–36, 63
See application file for complete search history.

(56) References Cited

U.S. PATENT DOCUMENTS

| | | | | | |
|---|---|---|---|---|---|
| 4,449,476 | A * | 5/1984 | Voswinckel | B05C 1/0869 | 118/405 |
| 4,519,304 | A * | 5/1985 | Ripani | A23G 1/04 | 100/168 |
| 4,603,815 | A * | 8/1986 | Ripani | A23G 1/12 | 241/232 |
| 4,688,177 | A * | 8/1987 | Ripani | A23G 1/04 | 700/213 |
| 4,690,335 | A * | 9/1987 | Allers | B02C 25/00 | 241/152.2 |
| 4,746,070 | A * | 5/1988 | Kuster | A23G 1/12 | 241/231 |
| 5,154,037 | A * | 10/1992 | Focke | B31B 19/10 | 226/118.4 |
| 5,379,950 | A * | 1/1995 | Kuster | A23G 1/12 | 241/159 |
| 5,433,391 | A * | 7/1995 | Jagger | B02C 4/286 | 241/227 |
| 5,538,054 | A * | 7/1996 | L uhmann | B67C 3/007 | 141/1 |
| 5,984,846 | A | 11/1999 | Hirschberg et al. | | |
| 6,213,749 | B1 * | 4/2001 | Carle | A23G 1/10 | 425/141 |
| 6,517,016 | B1 * | 2/2003 | Feige | B02C 4/02 | 241/160 |
| 8,292,207 | B2 | 10/2012 | Fard et al. | | |
| 8,644,641 | B2 | 2/2014 | Abraham et al. | | |
| 9,387,479 | B2 * | 7/2016 | Bernauer | A23G 1/0033 | |
| 2007/0051836 | A1 | 3/2007 | Kirschner et al. | | |
| 2007/0131707 | A1 * | 6/2007 | Poole | B65B 1/12 | 222/14 |
| 2007/0205312 | A1 * | 9/2007 | Pierri | B02C 4/28 | 241/6 |
| 2009/0044567 | A1 * | 2/2009 | Johnson | C03B 5/245 | 65/29.17 |
| 2010/0091103 | A1 * | 4/2010 | Peltonen | B02C 21/02 | 348/82 |
| 2016/0250642 | A1 * | 9/2016 | Lindstrom | B02C 25/00 | |

FOREIGN PATENT DOCUMENTS

| | | | | |
|---|---|---|---|---|
| CN | 101426582 | | 5/2009 | |
| CN | 201720083 | | 1/2011 | |
| DE | 3526260 | A1 * | 1/1987 | B02C 4/04 |
| DE | 4414367 | | 10/1995 | |
| DE | 19618077 | | 7/1997 | |
| EP | 0072504 | | 2/1983 | |
| EP | 0492080 | | 7/1992 | |
| EP | 0712469 | | 5/1996 | |
| EP | 0953291 | | 11/1999 | |
| EP | 2103223 | | 9/2009 | |
| FR | 1378556 | | 11/1964 | |
| GB | 1008065 | A * | 10/1965 | B02C 4/28 |
| JP | 61278363 | A | 12/1986 | |
| JP | 9-501763 | A | 2/1997 | |
| JP | 2005169198 | A | 6/2005 | |
| JP | 2009251637 | A | 10/2009 | |
| JP | 2010538830 | A | 12/2010 | |
| JP | 2011045059 | A | 3/2011 | |
| WO | 2007/121596 | A2 | 11/2007 | |
| WO | WO 2007121596 | A2 * | 11/2007 | A23G 1/12 |

OTHER PUBLICATIONS

Chinese Official Office Action issue in corresponding Chinese Application No. 201280022924.0 dated Feb. 15, 2015.

* cited by examiner

DEVICE AND METHOD FOR COMMINUTING PARTICLES IN LIQUID MATERIAL

The present invention relates to a device and a method and to a calibration method for a regulating unit of a device for the comminution of particles in a flowable material according to the preamble of the independent claims.

When a roller mill is in operation, various process parameters have to be regulated individually in order to ensure a uniform grinding quality. Since the mechanical properties of the grinding stock differ from one another from batch to batch or else vary within a grinding process, particularly in the case of several passes through the same roller mill, it is necessary to ensure that the process parameters are adapted to respective mechanical properties of the grinding stock.

Adjustable process parameters are the roller nip, roller pressure force, roller temperature, grinding stock temperature and roller rate of rotation or roller rotational speed.

It is known from EP 0 492 080, when fixed filling levels are reached inside the feed bunker of a roller mill, to vary a process parameter, in particular the roller pressure force, by the amount of a specific value. This takes place until the filling level has leveled out at a stable value, without a desired value being specified. What is achieved thereby is that a roller mill can be operated with stable regulation of the process parameters even when mechanical properties of the grinding stock vary.

One disadvantage of this method is that, by the pressure force and filling level in the feed bunker being varied, the degree of comminution of the particles in the grinding stock after rolling varies, depending on the pressure force and filling level. A product with a constant particle size cannot therefore be produced.

EP 2 103 223 discloses a method and a device for reducing the particle size in a material, in particular a chocolate mass, a nip between two rollers being varied as a function of the electrical power consumption of a drive motor of the rollers.

Furthermore EP 0 953 291 describes a method for the production of chocolate, the roller nip between two rollers being measured and compared with a reference value. On the basis of the difference which is determined, the rate of rotation of one of the rollers is varied.

An object of the present invention is to provide a device for the comminution of particles in a flowable material, which avoids the disadvantages of the prior art and, in particular, makes it possible to have a constant degree of comminution, even when properties of the grinding stock vary. This object is achieved by means of a device as claimed in claim 1.

The device according to the invention for the comminution of particles in a flowable material comprises at least one pair of rollers, for which at least one process parameter, in particular the roller pressure force of the rollers and/or the rate of rotation of at least one of the rollers, can be set.

The number of pairs of rollers is defined by the number of roller nips between the rollers. A pair of rollers is usually composed of two rollers. If the device comprises more than one pair of rollers, then one and the same roller may belong to different pairs of rollers. There does not therefore necessarily have to be twice as many rollers as pairs of rollers. In a limiting case, a pair of rollers may comprise only one roller, to be precise when the roller nip is formed between a roller and a wall.

The device comprises, furthermore, a filling level meter for measuring the filling level of the flowable material in a roller nip or in a roller trough preceding the rollers.

The filling level meter can measure the filling level in the roller nip of the pair of rollers, for which a process parameter can be set, or in another preceding or following roller nip. Alternatively, the filling level may be measured in a preceding roller trough.

The device has, moreover, a regulating unit which varies at least one process parameter as a function of the measured filling level of the flowable material.

In the context of the application, "flowable" material is understood to mean a material, the viscosity of which is sufficiently low to enable the material to deliquesce automatically. In the context of the application, in particular, liquids and semiliquids and also pourable materials, such as powder, are deemed to be flowable material. The device is suitable, in particular, for the comminution of particles in a powder or semiliquid for the production of a chocolate mass.

The device is preferably a roller mill. The device preferably has at least two rollers which are arranged as a pair of rollers and are pressed one against the other by pressure force. Furthermore, even further rollers may be arranged in the device. In particular, the device according to the invention may have four or five rollers.

The number of rollers which are used actively during the comminution process may be variable. The number of activated rollers may be made dependent upon the desired film thickness and/or upon the mass to be comminuted. Thus, for example, at the start of a comminution process, only two or three rollers may be used, and later, for example in the case of renewed passes of the flowable mass through the device, further rollers may be added.

As a rule, film transfer, such as is necessary when more than two rollers are used, is more likely if the material already has a certain fineness.

Rollers which are to be deactivatable may be designed as to be capable of being lifted off in such a way that, in the lifted-off state, they do not come into contact with the flowable mass.

A pair of rollers is preferably preceded by a roller trough, that is to say the roller trough is arranged upstream of the rollers in the direction of processing of the flowable material. The flowable material is conveyed first into the roller nip or the roller trough via a delivery arrangement, such as, for example, a storage bunker or a feed belt.

The delivery of the grinding stock especially preferably takes place in a constant mass flow. That is to say, the delivered quantity of grinding stock per unit of time is always identical while the device is in operation. The delivered quantity can preferably be set exactly by means of a corresponding delivery device.

As a result of the rotation of the rollers, the flowable material is conveyed through the roller nip located between the rollers. As a result of the pressure force of the rollers and the shear forces generated by the rotational movement, the comminution of the particles located in the flowable material takes place. These particles are, for example, sugar crystals, cocoa nibs, milk powder or the like.

At least one of the rollers of the pair of rollers is pressed against the second roller via a pressure arrangement. Both rollers preferably have a pressure arrangement, the two rollers being pressed reciprocally one against the other. The pressure arrangement is, for example, a hydraulic piston or the like. Alternatively, one roller may also be arranged rigidly, while the second roller of the pair of rollers is pressed against the rigid roller. Furthermore, the rollers may also be arranged in such a way that a different pressure force can be set at the two ends of the rollers.

Preferably, furthermore, the rate of rotation can be adjusted individually for each of the rollers of the pair of rollers. This may take place, for example, via a separate rotational speed control of the drive motors of the rollers or, alternatively, via adjustable gears between a common drive motor and individual rollers.

The device preferably has at least one sensor which measures the filling level of the flowable material in the roller nip and/or in the roller trough. In order to improve the measurement accuracy, the device may also have a plurality of sensors which measure the filling level. These are preferably contactless sensors.

In the context of this application, the measurement of the filling level in the roller nip is understood to mean the measurement of the filling level of a grinding stock accumulation above the roller nip. The grinding stock collecting upstream of the roller nip forms this grinding stock accumulation.

The regulating unit varies at least one process parameter as a function of the measured filling level of the flowable material in the roller nip or in the roller trough. The regulating unit is preferably a microcontroller unit. The regulating unit can in this case preferably be set at a desired value for the filling level to be maintained, for example via an input device. The regulating unit is preferably configured in such a way that, in the case of a specified deviation of the desired value for the filling level, for example by 5 cm, it varies at least one process variable by the amount of a specific value, for example the rate of rotation of the rollers is reduced by the amount of 50 revolutions per minute. The regulating unit in this case especially preferably has an additional memory unit in which, for example, filling level desired values for different grinding stock and/or for different degrees of particle comminution to be achieved are stored. Preferably, furthermore, specific variation values of the process parameters can be stored for different grinding stock and/or for different degrees of comminution to be achieved.

The regulating unit preferably varies the pressure force of the rollers and/or the rate of rotation of at least one of the rollers. Alternatively and/or additionally, further process parameters could also be varied by the regulating unit, such as, for example, the roller nip or the rate of delivery of the flowable material into the roller nip or into the roller trough. The rate of delivery can be set, for example, via the pumping capacity for conveying the flowable material.

Variations in the mechanical, physico-chemical or structural properties of a flowable material have an effect upon the throughput of the material between the rollers. As the filling level of the flowable material in the roller nip or in the roller trough is measured, this throughput of material can be calculated at any time. In this case, either the variation in the filling level per unit of time is calculated or a check is made as to whether the filling level remains at an identical height during the constant introduction of flowable material into the roller nip or into the roller trough, that is to say the quantity of material delivered corresponds to that quantity which is drawn in between the rollers in the same unit of time.

The throughput through a roller nip may also be determined by a comparison of the inflowing or the outflowing quantity which are in each case determined, for example, by means of a flowmeter.

Preferably, the grinding stock is introduced in a constant mass flow into the roller trough respectively into the roller nip by means of a delivery arrangement. If a constant filling level in the roller trough respectively in the roller nip is maintained by varying the pressure force of the rollers and/or the rate of rotation of at least one roller, the throughput and with it the degree of comminution can be kept constant.

The throughput may be measured by means of direct measurement in the delivery arrangement, the discharge arrangement or the device. Moreover, the delivery arrangement may be configured in such a way that the quantity of grinding stock introduced into the roller nip or roller trough can be set.

The device according to the invention thus makes it possible to comminute particles in a flowable material in a constant throughput and with a uniform degree of comminution of the particles, even when the properties of the flowable material delivered to the pair of rollers vary.

The filling level meter preferably comprises an optical or acoustic sensor. The sensor may in this case measure the filling level in the roller nip or in the roller trough, for example, by means of a laser beam, infrared beams or ultrasonic waves. The use of such sensors allows contactless measurement of the filling level of the flowable material in the roller nip or roller trough. Measurement may in this case take place at a specific point one-dimensionally or multidimensionally. One-dimensional measurement is understood to mean determination in only one direction of space, that is to say, in this case, filling level measurement along one direction of space. Multidimensional measurement may be used, for example, for determining the filling level volume or other geometric variables. By means of the device according to the invention, point-measured one-dimensional and multidimensional filling levels can be determined in a short time and even in real time.

The filling level meter preferably comprises a camera directed at the roller nip and an image evaluation unit which is suitable for calculating the filling level on the basis of a camera image. By means of such an arrangement, the filling level of the flowable material in the roller nip or in the roller trough can be measured continuously over the entire width and/or length of the roller nip. The image evaluation unit preferably has corresponding evaluation software which makes it possible to determine the filling level simultaneously at various points within the roller nip or roller trough. Advantageously, moreover, the evaluation unit has an indicator which indicates in real time the image detected by the camera, so that it is possible for the operating personnel even to check the filling level visually.

The regulating unit is preferably configured in such a way that, when the flowable material is delivered in a constant volume flow into the roller nip or into the roller trough, the filling level of the flowable material in the roller nip or in the roller trough is held at a predetermined or predeterminable value by varying the pressure force and/or the rate of rotation of at least one of the rollers. It can thereby be ensured that, despite varying properties of the flowable material, particularly when the flowable material executes several passes through the same roller mill by means of a return system, a constant throughput is ensured. This throughput may even be kept constant at a value or at a value range solely during periods of defined time. The time periods can be set, for example, on the basis of empirical values or are defined on the basis of variations in the filling level.

In the context of the present application, "constant volume flow" is understood to mean that the same volume of flowable material is delivered and/or conveyed per unit of time.

Preferably, further, a feed arrangement for delivering the flowable material into the roller nip or into the roller trough is arranged upstream of the rollers in the material flow direction. This makes it possible to deliver flowable material into the roller nip or into the roller trough, especially preferably in an adjustable and/or constant volume flow.

The device may be equipped with a return arrangement which conducts at least part of the material already delivered through the rollers once again through the at least one pair of rollers.

The mass may be passed through the roller nips as often as is necessary to achieve the desired film thickness. By means of multiple passes through the rollers, for example, the same result can be achieved with a two-high or three-high rolling mill as with a five-high rolling mill.

The device preferably has, furthermore, a measuring device for determining the particle thickness in the grinding stock, in particular a fineness meter or a film thickness meter. This may be an electromagnetic, optoelectronic, acoustic or mechanical measuring arrangement. The measuring device is preferably mounted in the vicinity of a grinding roller and the fineness or film thickness on the grinding roller is measured. Alternatively, the measuring device may be mounted on a separate discharge roller and the fineness or layer thickness of the latter measured.

In particular, a fineness meter, using light in the near-infrared range, is used for fineness measurement. The wavelength is tuned to the material to be measured, so that the quantity of defined product ingredients, such as sugar and fat, which is correlated to the fineness of the product, can be determined from the absorbed radiation. The correlation is product-specific and has to be determined beforehand by calibration. The meter radiates infrared light onto a product layer on a roller, measures the reflected light quantity and calculates the fineness of the product in micrometers. A scavenging air unit protects the meter window against soiling.

Preferably, further, the device has a regulating unit which ensures that at least part of the material is conducted into the return arrangement if the fineness or film thickness has not yet reached the desired value.

In particular, the regulating unit is configured in such a way that the desired value can be set according to the customer's wishes.

Especially fine chocolate, such as is often required, for example, on the Asian market, demands film thicknesses of between 12 and 18 micrometers. As a rule, however, even chocolates with film thicknesses of between 18 and 30 micrometers are perceived as fine chocolates, since smaller structures mostly cannot be dissolved by the tongue receptors.

For many applications, however, even a film thickness of between 30 and 40 micrometers is sufficient.

Filling masses for chocolate usually have film thicknesses of between 35 and 50 micrometers.

The invention relates, moreover, to a device, in particular as described above, for the comminution of particles in a flowable material, in particular in a powder or semiliquid for the production of a chocolate mass. The device comprises at least one pair of rollers, for which at least one process parameter, in particular the roller pressure force, the temperature and/or the rate of rotation of at least one of the rollers, can be set, and an arrangement for detecting the throughput of flowable material through a roller nip. The device comprises, moreover, a regulating unit which varies at least one process parameter, in particular selected from the roller pressure force, the roller nip and the roller rate of rotation of at least one of the rollers, and the combinations thereof, as a function of the measured throughput of flowable material in the roller nip or as a function of the change in throughput.

For example, the throughput in the roller nip of the pair of rollers, the process parameters of which can be set, can be determined.

The arrangement for detecting the throughput preferably comprises at least one measuring device for a parameter, on the basis of which the throughput can be determined. As described above, the measuring device may be a filling level meter. However, the throughput may also be determined by means of a flowmeter or from the quantity difference between the outflowing and the inflowing mass, which can be determined by volume or weight measurement.

The regulating unit is preferably designed such that a fixed constant throughput is achieved.

The invention relates, moreover, to a plant for the comminution of particles in a flowable material, in particular in powders or semiliquids for the production of a chocolate mass, in which a plurality of devices for comminution, as described above, are arranged one behind the other in the material flow direction. The respective devices can preferably be connectable into the material flow, so that the number of devices involved in the comminution process is selectable.

A further aspect of the present invention relates to a method for the comminution of particles in a flowable material.

In the method according to the invention for the comminution of particles in a flowable material, in particular in powders or semiliquids for the production of a chocolate mass, the particles are comminuted between at least one pair of rollers.

The process parameters of at least one pair of rollers can preferably be set.

For this case, the throughput of flowable material through a roller nip is detected or a filling level of the flowable material in a roller nip or in a roller trough which precedes a pair of rollers is measured.

For example, the throughput through a roller nip or the filling level in the roller nip of the pair of rollers, process parameters of which can be set, is measured.

At least one process parameter, in particular a process parameter of a pair of rollers, further, in particular, the roller pressure force and/or the roller rate of rotation of at least one of the rollers, is varied as a function of the detected throughput and/or of the measured filling level of the flowable material.

Additionally or alternatively, the temperature of at least one roller may also be varied.

This makes it possible to comminute the particles contained in the flowable material in a constant throughput and/or with a desired, in particular uniform, degree of comminution.

Preferably, flowable material is delivered continuously to the roller nip or roller trough, for example via a feed belt.

Especially preferably, the filling level is measured continuously. As a result, variations in the filling level in the roller nip or in the roller trough can be detected very quickly and a corresponding variation of at least one process parameter can take place without delay.

The filling level of the flowable material in the roller nip and/or in the roller trough is preferably measured contactlessly, in particular by means of an acoustic or optical sensor. Contactless sensors have the advantage that the measurement data are not falsified by material which has remained.

Also, where these sensors are concerned, only a lens has to be cleaned, thus reducing the outlay in maintenance terms.

The throughput may be determined by a filling level measurement. The throughput may also be determined by a flow measurement or a differentiation of an outflowing and an inflowing quantity, that is to say, for example, by volume or weight measurements of the inflowing and/or outflowing mass.

Preferably, a desired value or a desired value range for the throughput and/or filling level is fixed and the at least one process parameter is varied automatically in such a way that the throughput and/or measured filling level correspond/corresponds to the specified desired value or lie/lies within the desired value range.

A desired value range in the context of this application is a range within which the throughput or filling level may be located, without regulating action taking place. That is to say, for example, minor fluctuations in the filling level do not yet cause any variations in the process parameters, but instead only the fact that the measured filling level has departed from the desired value range.

Preferably, with preset process parameters, the grinding stock is additionally comminuted by the at least one pair of rollers until a stationary state has been established. The filling level in the roller nip or in the roller trough, which is established in the stationary state, is fixed as the desired value or, based on this value, defines a desired value range.

The process parameters are preferably varied automatically by a regulating unit. The regulating unit is preferably adjusted or adjustable in such a way that a variation in the filling level by the amount of a specific value causes the variation of at least one process parameter by the amount of a defined value.

Preferably, in the device, a minimum nip width can be set which cannot be undershot during the operation of the device, at least during the start-up of the latter. The minimum nip width can preferably be set via a corresponding mechanism. Allowing a minimum nip width simplifies the start-up of the roller mill, since the grinding stock is drawn in more effectively than when the rollers are pressed completely one against the other.

Alternatively, even when the roller mill is being started up, the pressure force may be reduced for a certain time until an appropriate throughput of material is achieved.

Preferably, in the method, a calibration step may first take place, in which the relationship between the degree of comminution and at least one process parameter is determined. For example, with a given pressure force and with an intended throughput, the rate of rotation of at least one roller may be varied until a constant filling level of the grinding stock in the roller nip or in the roller trough is established. The accompanying degree of comminution is then determined, and a process variable characteristic map can be prepared which can correspondingly be stored in the regulating unit or in a control device and can be used for regulation.

A calibration step in which the desired value or the desired value range of the filling level is fixed preferably takes place.

Preferably, in the calibration step, the relationships between the process parameters, the filling level, the throughput and the degree of comminution of the particles can be determined. In particular, by two of these values being kept constant and by a third value being varied, the effect of this variation upon the fourth value can be determined.

Preferably, in a further method step, the film thickness on at least one roller is measured, in particular by means of a film thickness meter which has a sensor for detecting the film thickness.

Preferably, further, the method according to the invention is repeated, that is to say the mass is comminuted one more time by the at least one pair of rollers. In particular, the method comprises a test step in which it is found whether a test variable, in particular a measured fineness or film thickness, has reached and/or overshot or undershot a desired value.

Further, in particular, the method comprises a control step, the preceding method steps being repeated as long as the test variable, in particular the measured fineness or film thickness, has not yet reached the desired value.

Further, in particular, the method comprises a control step, one or more additional rollers being activated as soon as the test variable has reached a desired value.

Further, in particular, the method comprises a setting step, by means of which at least one desired variable, in particular a desired fineness or film thickness, or a sequence of desired variables is specified.

A further aspect of the present invention relates to a device for the comminution of particles in a flowable material, in particular in a powder or semiliquid for the production of a chocolate mass, which allows an appreciable increase in throughput, particularly for a device, as described above. This object is achieved by means of a device as claimed in claim 15.

The device according to the invention comprises at least one pair of rollers. The device preferably comprises, furthermore, at least one further roller which is pressed against the pair of rollers. Preferably, further, the device may also have further rollers which are arranged sequentially one behind the other and are pressed one against the other. At least one process parameter of the at least one pair of rollers or of the at least one additional roller may be varied, in particular the pressure force and/or roller rate of rotation of at least one of the rollers. Preferably, furthermore, at least one roller of the pair of rollers and/or at least one further roller are/is configured as a camberless roller.

It was found that the combination of camberless rollers and the variable pressure force and also variable rate of rotation of at least one roller makes it possible to have an appreciable increase in the throughput of a roller mill, without the degree of comminution and/or the quality of the ground stock decreasing.

Preferably, the camberless roller has a rigid core jacket, preferably made from steel, and also a thin wall. Furthermore, an elastic layer is arranged between the core jacket and the wall. The core jacket may be designed as a hollow roller with a rigid roller jacket.

Rollers of this type are described, for example, in EP 0 712 469 and make it possible to have a constant degree of comminution over the entire roller length, even in the case of a varying pressure in the roller nip. The advantage, as compared with the cambered rollers conventionally used, is that, under any pressure in the roller nip, the latter always has a constant width over the entire length.

Preferably, the at least one process parameter is varied on the basis of a measured value, in particular a filling level of the grinding stock in the roller nip or in a roller trough preceding the at least one pair of rollers.

The device makes it possible to have an easily controllable and smooth progress of the rolling operation, thus leading to a defined degree of comminution of the particles and therefore ensuring a good product quality.

Further details and embodiments of the present invention may be gathered from the following description of the figures and examples. In the figures.

Figure 1:
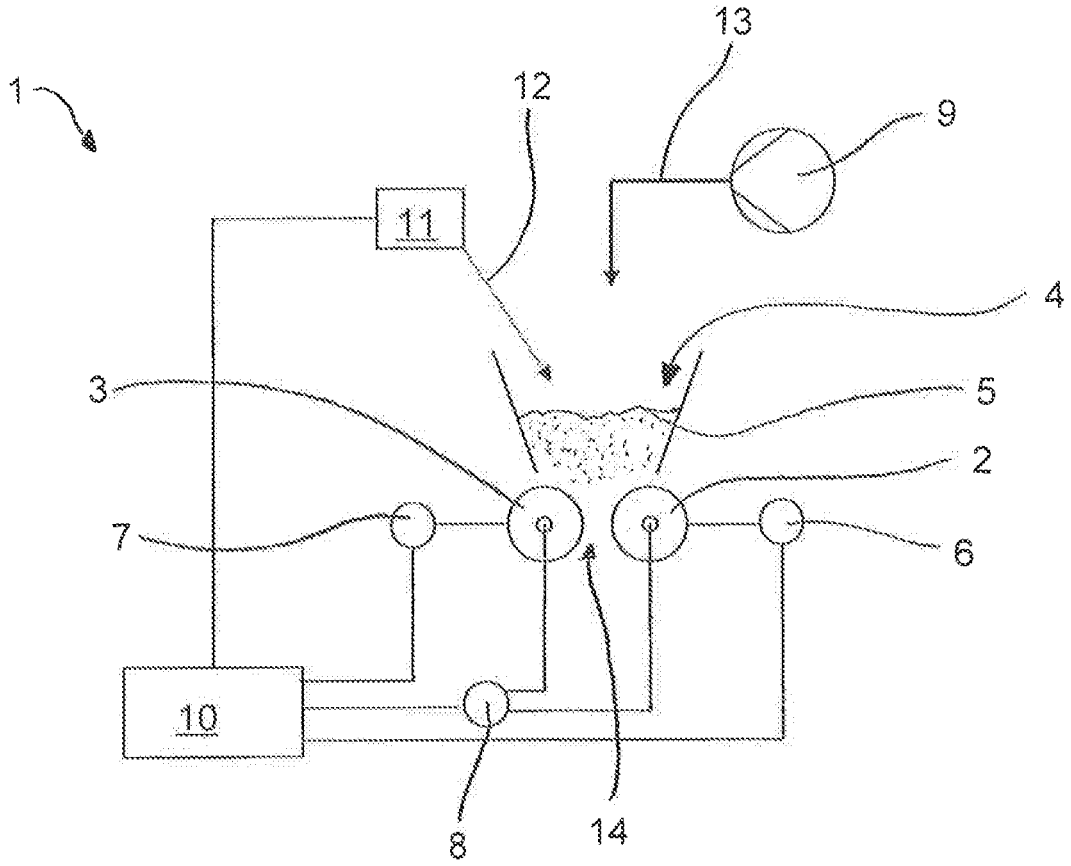
FIG. 1 shows a diagrammatic illustration of a first example of a device according to the invention.

FIG. 1 shows a diagrammatic illustration of a device 1 according to the invention. The device 1 has at least two rollers 2, 3 arranged as a pair of rollers. Between the rollers 2, 3 there is a roller nip 14. Each of the two rollers 2, 3 of the pair of rollers is driven by a separate motor 6, 7 having a controlled rotational speed. The pressure force between the rollers 2, 3 is set via a pressure regulator 8. Upstream of the rollers 2, 3 a roller trough 4 is arranged, to which flowable material 13 is delivered by a feed arrangement 9. The filling level 5 of the flowable material 13 in the roller trough 4 is measured by a filling level meter 11. The measuring direction of the filling level meter 11 is such that the filling level 5 of the flowable material in the roller trough 4 can be measured. The measured filling level is transmitted to a regulating unit 10. On the basis of the measured filling level 5, at least one process parameter is varied by the regulating unit 10. In particular, the rate of rotation of at least one roller 2, 3 is varied via the rotational speed of the accompanying motor 6, 7. Alternatively, the pressure force of the rollers 2, 3 may be varied by the pressure regulator 8.

EXAMPLE 1

A constant pressure force of the rollers of 28 bar and a constant throughput of 1200 kg/h give rise in an exemplary material to a particle size of 80 μm. If the properties of the flowable material change during the method, the product draw-in of the material between the rollers and therefore the throughput are also varied. In the example, in the case of a constant delivery of material into the roller nips or into the roller trough, the filling level is varied in such a way that it decreases. This variation is recorded by the filling level meter, whereupon a corresponding variation in the pressure force, for example an increase in pressure in steps of 0.5 bar, takes place by means of the regulating unit. This variation continues until the desired value of the filling level in the roller nip or in the roller trough is reached again. In the event of major variations in throughput, the rotational speed of the rollers is additionally varied, for example by 30 to 100 revolutions per minute.

EXAMPLE 2

When non-cambered rollers with elastic jacket intermediate material are used for generating small particles, for example 40 μm, a high pressure force is required, for example 35 bar, which results in a correspondingly lower throughput of flowable material. Consequently, with a constantly high pressure, the throughput can be increased by increasing the roller rotational speeds.

EXAMPLE 3

With a set starting pressure in the roller nip of 28 bar and with roller rates of rotation of 50 rev/min for a first roller and of 100 rev/min for the second roller of the pair of rollers, grinding stock is ground. This results in a throughput of 800 kg/h with a degree of comminution of the particles located in the grinding stock of 30 μm.

If the pressure in the roller nip is increased to 35 bar, the throughput is reduced to 600 kg/h, the degree of comminution of the particles falling to 20 μm.

An increase in the roller rates of rotation to 75 rev/min for the first roller and to 150 rev/min for the second roller increases the throughput to 1000 kg/h, the degree of comminution of the particles rising again to 30 μm.

Furthermore, by further increasing the pressure to 45 bar and by increasing the roller rates of rotation to 75 rev/min for the first roller and to 150 rev/min for the second roller, the throughput can be set at the original 800 kg/h, with a degree of comminution of the particles of 20 μm.

A continuous method is achieved when the filling level of the grinding stock in the roller nip or in a roller trough preceding the at least one pair of rollers remains constant. In this state, the process parameters are set in such a way that the delivered quantity of grinding stock corresponds to the discharged quantity, that is to say a preselected throughput is achieved.

Figure 2:
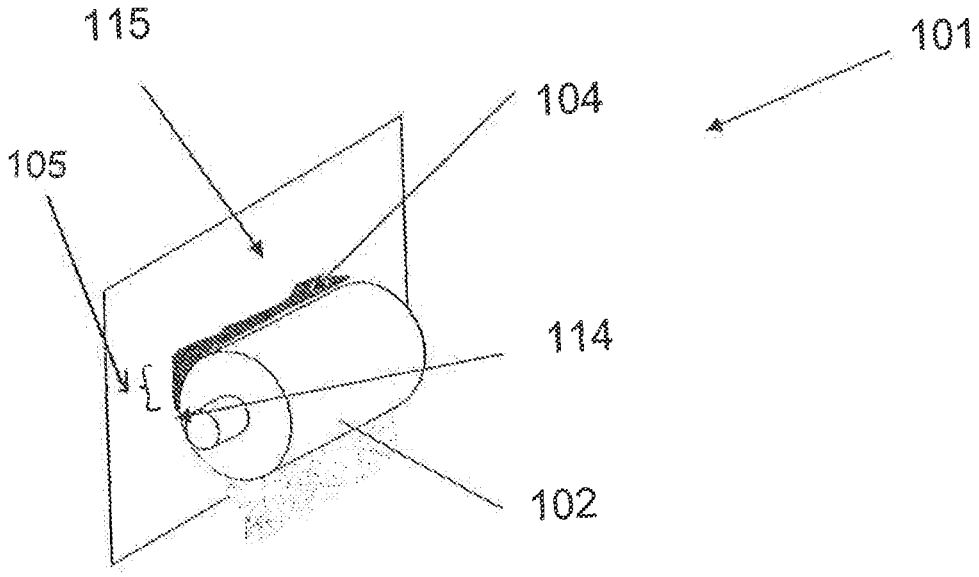
FIG. 2 shows a diagrammatic illustration of a second example of a device according to the invention.

FIG. 2 shows a diagrammatic illustration of a second example of a device 101 according to the invention.

A roller 102 forms with a fixed wall 115 a roller nip 114. A process parameter of the roller 102, for example the roller pressure force or the rate of rotation, can be regulated as a function of the filling level 105 of the flowable mass in the roller nip 114.

Figure 3:
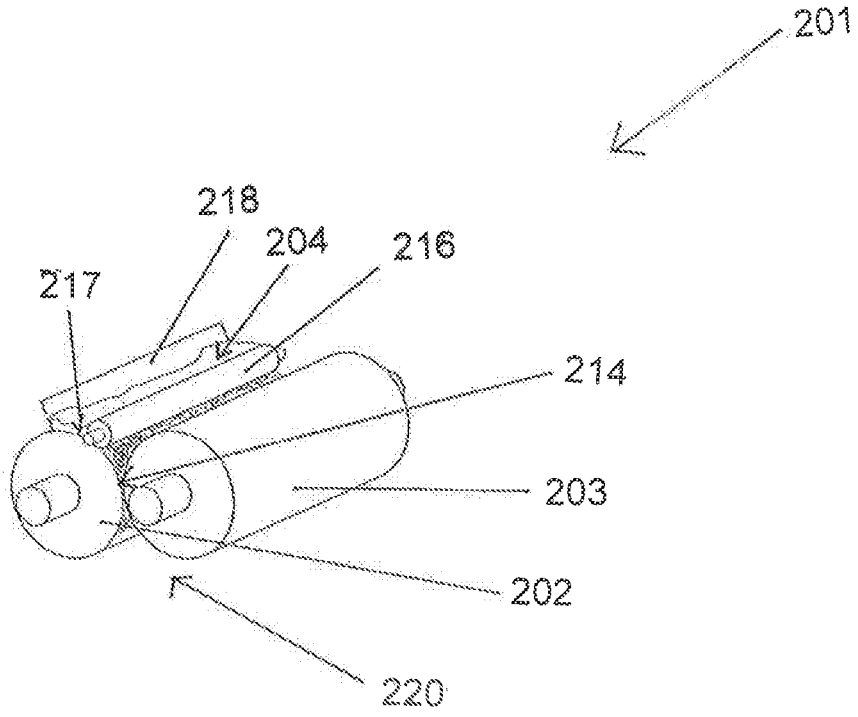
FIG. 3 shows a diagrammatic illustration of a third example of a device according to the invention.

FIG. 3 shows a diagrammatic illustration of a third example of a device 201 according to the invention.

Two rollers 202, 203 of identical size form a first pair of rollers 220 for which a process parameter, for example the roller pressure force or the rate of rotation of at least one of the rollers 202, 203, can be set.

The rollers 202, 203 are preceded by a further roller 216 of smaller diameter, which serves as an applicator roller and with one of the rollers 203 forms a further pair of rollers. This encloses a roller nip 217 in which initial stress upon the flowable material occurs.

A three-high rolling mill with two pairs of rollers is thus obtained.

The applicator roller 216 forms with a trough wall 218 a roller trough 204.

A process parameter of the pair of rollers 220, for example the roller pressure force or the rate of rotation of at least one roller 202, 203, can be regulated as a function of the filling level 205 of the flowable mass in the roller trough 204.

Figure 4:
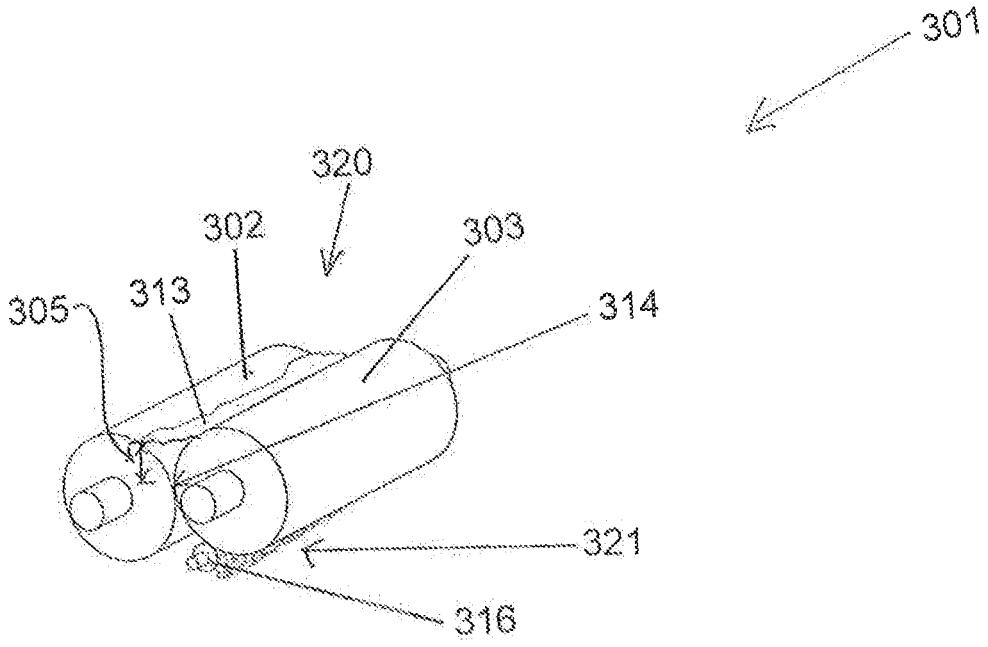
FIG. 4 shows a diagrammatic illustration of a fourth example of a device according to the invention.

FIG. 4 shows a diagrammatic illustration of a fourth example of a device 301 according to the invention in the form of a further example of a three-high rolling mill.

A roller 316 having a smaller diameter follows a pair of rollers 320 with two larger rollers 302, 303.

A process parameter of the pair of rollers 320, for example the roller pressure force or the rate of rotation of at least one roller 302, 303, or of the second pair of rollers 321, for example the roller pressure force or the rate of rotation of at least one roller 303, 316, can be regulated as a function of the filling level 305 of the flowable mass 313 in the roller nip 314 of the first pair of rollers 320.

Figure 5:
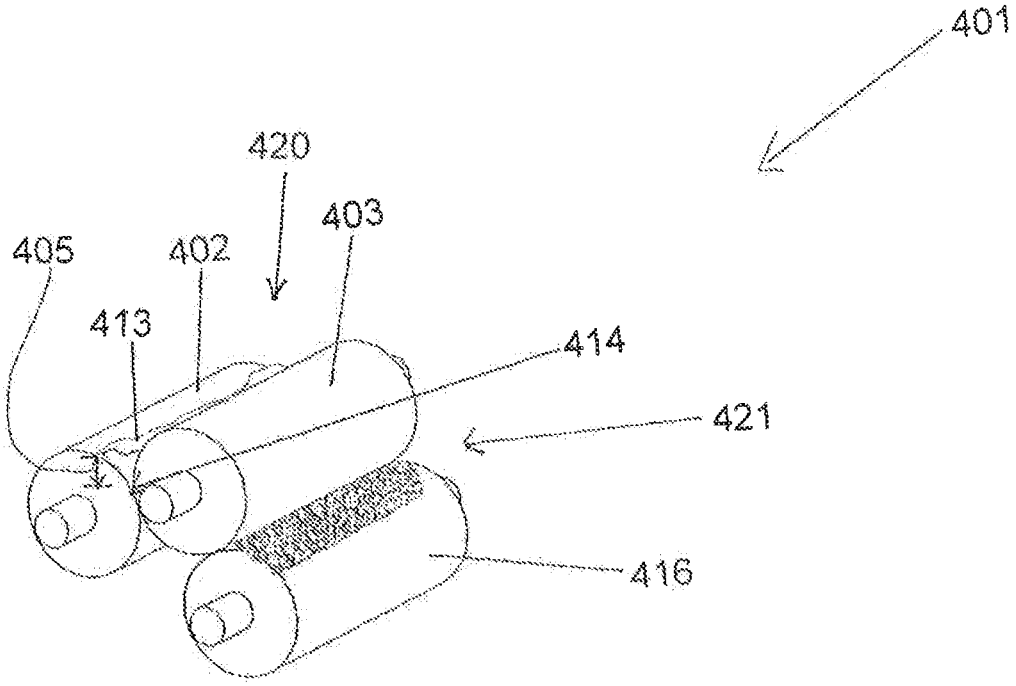
FIG. 5 shows a diagrammatic illustration of a fifth example of a device according to the invention.

FIG. 5 shows a diagrammatic illustration of a fifth example of a device 401 according to the invention in the form of a further example of a three-high rolling mill.

The three-high rolling mill likewise has two pairs of rollers 420, 421.

A process parameter of the pair of rollers 420, for example the roller pressure force or the rate of rotation of at least one roller 402, 403, or of the second pair of rollers 421, for example the roller pressure force or the rate of rotation of at least one roller 403, 416, can be regulated as a function of the filling level 405 of the flowable mass 413 in the roller nip 414 of the first pair of rollers 420.

In addition, a fineness meter, not illustrated explicitly in the figure, may be provided, which determines the fineness of the product located on the discharge roller 416. If the fineness has not yet reached a fixed desired value, the product can be delivered to the first roller nip 414 again.

The invention claimed is:

1. A method for comminution of particles in a flowable material for production of a chocolate mass, the particles being sugar crystals, cocoa nibs, milk powder or combinations thereof, and the method comprising:

comminuting the particles between at least one pair of rollers, for which at least a rate of rotation of at least one roller of the pair of rollers can be set, and measuring a current filling level of the flowable material in a roller nip or in a roller trough preceding a pair of rollers, wherein at least the rate of rotation of at least one roller of the pair of rollers is varied as a function of the measured filling level of the flowable material, and at least one of the filling level of the flowable material in the roller nip or in the roller trough and variations in the filling level are continuously determined contactlessly by a filling level meter; and the filling level meter has a camera directed at the roller nip and an image evaluation unit which determines the filling level based on a camera image.

2. The method as claimed in claim 1, wherein the flowable material is delivered continuously to the roller nip or to the roller trough.

3. The method as claimed in claim 1, wherein the filling level is measured continuously.

4. The method as claimed in claim 1, wherein, first, a desired value for the filling level is fixed, and at least one process parameter is varied automatically in such a way that the measured filling level corresponds to the specified desired value.

5. The method as claimed in claim 4, wherein the at least one process parameter is varied automatically by a regulating unit.

6. The method as claimed in claim 4, wherein, first, a calibration step takes place, in which a value of the at least one process parameter is fixed, at which at least one of a specific degree of comminution of the particles in a grinding stock is achieved and at which a desired value or desired value range for the filling level is determined.

7. A method for comminution of particles in a flowable material for production of a chocolate mass, the particles being sugar crystals, cocoa nibs, milk powder or combination thereof, and the method comprising:

comminuting the particles between at least one pair of rollers, for which at least a rate of rotation of at least one roller of the pair of rollers can be set, and measuring a current filling level of the flowable material in a roller nip or in a roller trough preceding a pair of rollers, wherein the rate of rotation of at least one roller of the pair of rollers is varied as a function of the measured filling level of the flowable material, and the current filling level of the flowable material in the roller nip or in the roller trough is continuously measured contactlessly by one of a filling level meter; and the filling level meter has a camera directed at the roller nip and an image evaluation unit which determines the filling level based on a camera image.

8. The method as claimed in claim 1, wherein the flowable material is delivered into the roller nip or into the roller trough by a feed arrangement, which is arranged upstream of the pair of rollers in the material flow direction.

9. The method as claimed in claim 1, wherein at least one roller is configured as a camberless roller.

10. A method for comminution of one of sugar crystals, cocoa nibs and milk powder, in a liquid flowable material, to produce a chocolate mass, and the method comprising:

comminuting one of sugar crystals, cocoa nibs and milk powder between at least one pair of rollers, for which at least a rate of rotation of at least one roller of the pair of rollers can be set, and measuring a current filling level of the liquid flowable material in a roller nip or in a roller trough preceding a pair of rollers, wherein the at least the rate of rotation of at least one roller of the pair of rollers is varied as a function of the measured filling level of the liquid flowable material, and at least one of the filling level of the liquid flowable material in the roller nip or in the roller trough and variations in the filling level are continuously determined contactlessly by a filling level meter viewing the roller nip or the roller trough; and the filling level meter has a camera directed at the roller nip and an image evaluation unit which determines the filling level based on a camera image.

* * * * *